US009709009B2

(12) United States Patent
Miyazaki et al.

(10) Patent No.: US 9,709,009 B2
(45) Date of Patent: Jul. 18, 2017

(54) LOW PRESSURE EXHAUST GAS RECIRCULATION APPARATUS

(75) Inventors: Shinsuke Miyazaki, Chiryu (JP); Akira Furukawa, Kariya (JP); Osamu Shimane, Kariya (JP); Kazushi Sasaki, Owariasahi (JP); Eiji Takemoto, Obu (JP)

(73) Assignee: DENSO CORPORATION, Kariya (JP)

( * ) Notice: Subject to any disclaimer, the term of this patent is extended or adjusted under 35 U.S.C. 154(b) by 1808 days.

(21) Appl. No.: 12/845,067

(22) Filed: Jul. 28, 2010

(65) Prior Publication Data

US 2011/0023846 A1 Feb. 3, 2011

(30) Foreign Application Priority Data

Jul. 31, 2009 (JP) ..... 2009-179537

(51) Int. Cl.

| | |
|---|---|
| ***F02M 25/07*** | (2006.01) |
| ***F02M 26/51*** | (2016.01) |
| ***F02M 26/05*** | (2016.01) |
| ***F02M 26/06*** | (2016.01) |
| ***F02M 26/49*** | (2016.01) |
| ***F02M 26/25*** | (2016.01) |
| ***F02M 26/28*** | (2016.01) |

(Continued)

(52) U.S. Cl.

CPC ..... *F02M 26/51* (2016.02); *F02M 26/05* (2016.02); *F02M 26/06* (2016.02); *F02M 26/25* (2016.02); *F02M 26/28* (2016.02); *F02M 26/49* (2016.02); *F02M 26/64* (2016.02); *F02M 26/70* (2016.02)

(58) Field of Classification Search

USPC ..... 123/559.1, 568.16, 568.17, 568.18, 123/568.19, 568.2, 568.21; 701/108

See application file for complete search history.

(56) References Cited

U.S. PATENT DOCUMENTS

| | | | | |
|---|---|---|---|---|
| 4,224,912 | A * | 9/1980 | Tanaka | 123/568.19 |
| 5,562,085 | A | 10/1996 | Kosuda et al. | |
| 5,979,870 | A * | 11/1999 | Junier | 251/305 |

(Continued)

FOREIGN PATENT DOCUMENTS

| | | |
|---|---|---|
| EP | 1 420 158 | 5/2004 |
| EP | 2 218 895 | 8/2010 |

(Continued)

OTHER PUBLICATIONS

Japanese Office Action dated Jun. 14, 2011, issued in corresponding Japanese Application No. 2009-179537 with English Translation.

*Primary Examiner* — Hai Huynh
*Assistant Examiner* — Gonzalo Laguarda
(74) *Attorney, Agent, or Firm* — Nixon & Vanderhye P.C.

(57) ABSTRACT

A low pressure EGR regulating valve is driven by an electric actuator, and an output of the electric actuator is transmitted to an intake air throttle valve through a link device. An ECU executes a failure determination to determine presence of a failure in a case where a sensed opening degree, which is sensed with a low pressure EGR opening degree sensor, is other than an opening degree that corresponds to a maximum opening degree of the throttle valve limited by a mechanical stopper. The ECU executes the failure determination after the energization of the electric actuator is stopped in response to stopping of the engine.

11 Claims, 9 Drawing Sheets

(51) Int. Cl.
*F02M 26/64* (2016.01)
*F02M 26/70* (2016.01)

(56) References Cited

U.S. PATENT DOCUMENTS

| | | | | |
|---|---|---|---|---|
| 6,976,481 | B2 * | 12/2005 | Kobayashi et al. | 123/568.12 |
| 7,163,005 | B2 * | 1/2007 | Tussing et al. | 123/568.12 |
| 7,234,444 | B2 * | 6/2007 | Nanba et al. | 123/337 |
| 7,237,531 | B2 * | 7/2007 | Atkinson | 123/399 |
| 2007/0107708 | A1 * | 5/2007 | Uchiyama et al. | 123/568.18 |
| 2008/0141671 | A1 | 6/2008 | Takemoto | |
| 2011/0088674 | A1 * | 4/2011 | Shutty et al. | 123/568.21 |
| 2012/0145134 | A1 * | 6/2012 | Miyazaki et al. | 123/568.2 |

FOREIGN PATENT DOCUMENTS

| | | |
|---|---|---|
| JP | 54-023825 | 2/1979 |
| JP | 2001-207917 | 8/2001 |
| JP | 2003-106143 | 4/2003 |
| JP | 2003-343306 | 12/2003 |
| JP | 2006-291921 | 10/2006 |
| JP | 2006-300007 | 11/2006 |
| JP | 2008-128114 | 6/2008 |
| JP | 2009-046996 | 3/2009 |

* cited by examiner

LOW PRESSURE EXHAUST GAS RECIRCULATION APPARATUS

CROSS REFERENCE TO RELATED APPLICATION

This application is based on and incorporates herein by reference Japanese Patent Application No. 2009-179537 filed on Jul. 31, 2009.

BACKGROUND OF THE INVENTION

1. Field of the Invention

The present invention relates to a low pressure exhaust gas recirculation (EGR) apparatus.

2. Description of Related Art

A known low pressure EGR apparatus recirculates a portion of exhaust gas of an internal combustion engine from a low exhaust gas pressure area of an exhaust passage (a low exhaust gas pressure generating area, such as an area on a downstream side of a diesel particulate filter, which will be hereinafter abbreviated as DPF) to a low negative intake air pressure generating area of an intake air passage (a low negative intake air pressure generating area, such as an area on an upstream side of a throttle valve).

Previously proposed techniques will be described with reference to FIGS. 10 and 11. In the following description, similar components are indicated by the same reference numerals.

With reference to FIG. 10, a high pressure EGR apparatus 231 limits generation of NOx (nitride oxide) in exhaust gas of an engine 202. The high pressure EGR apparatus 231 is also often simply referred to as an EGR apparatus. The high pressure EGR apparatus 231 recirculates a portion of exhaust gas, which flows through an exhaust passage 203, as EGR gas to an area (a high negative intake air pressure generating area) on a downstream side of a throttle valve 225 in an intake air passage 204. With this construction, the EGR gas can be mixed into the intake air to limit the combustion temperature in a combustion chamber of the engine 202 and thereby to effectively limit the generation of NOx.

In the high pressure EGR apparatus 231, a high pressure EGR regulating valve 233 is provided in a high pressure EGR passage 232, which recirculates the EGR gas to the intake air passage 204. The high pressure EGR regulating valve 233 regulates an opening degree of the high pressure EGR passage 232. An engine control unit (ECU) controls an opening degree of the high pressure EGR regulating valve 233 such that a corresponding EGR quantity (a quantity of the recirculated exhaust gas per unit time), which corresponds to an operational state of the engine 202 (e.g., an engine rotational speed, an engine load), is obtained.

Furthermore, there is a constant market demand for a technique that further reduces the generation of NOx at the engine 202.

For instance, Japanese Unexamined Patent Publication No. 2008-150955A (US2008/0141671A1) teaches a technique of a low pressure EGR apparatus, which is provided in addition to the high pressure EGR apparatus, to reduce the generation of NOx.

One previously proposed technique, which employs the low pressure EGR apparatus, will now be described with reference to FIG. 11. The low pressure EGR apparatus 201 is an apparatus, which recirculates a portion of the exhaust gas from a low exhaust gas pressure area of the exhaust passage 203 (an area of the exhaust passage 203, which is located on the downstream side of the DPF 228 in the exhaust gas flow direction and at which the low exhaust gas pressure is generated) to a low negative intake air pressure generating area of the intake air passage 204 (an area of the intake air passage 204, which is located on the upstream side of the throttle valve 225 in the intake air flow direction and at which the low negative intake air pressure is generated). Thereby, the low pressure EGR apparatus 201 is adapted to recirculate the small quantity of the EGR gas to the intake air passage 204 with the relatively high accuracy.

Specifically, for instance, the low pressure EGR apparatus 201 of the vehicle, which has a turbocharger, recirculates the EGR gas from the area of the exhaust passage 203, which is located on the downstream side of the DPF 228 in the exhaust gas flow direction, to the area of the intake air passage 204, which is located on an upstream side of a compressor 223 in the intake air flow direction. By recirculating the exhaust gas from the low exhaust gas pressure area of the exhaust passage 203 to the low negative intake air pressure generating area of the intake air passage 204, it is possible to recirculate the small quantity of the EGR gas to the engine 202.

Therefore, although it is difficult for the high pressure EGR apparatus 231 to limit the generation of NOx in the operational range of the engine, at which the low concentration EGR gas is required, such as the operational range of the engine, at which the engine load is large, the low pressure EGR apparatus 201 can limit the generation of NOx even in the operational range of the engine, at which the low concentration EGR gas is required.

In the low pressure EGR apparatus 201, a low pressure EGR regulating valve 206 is provided in a low pressure EGR passage 205, through which the EGR gas is recirculated from the exhaust passage 203 to the intake air passage 204, to regulate an opening degree of the low pressure EGR passage 205. Similar to the high pressure EGR regulating valve 233 described above, the opening degree of the low pressure EGR regulating valve 206 is controlled by the ECU to provide the EGR quantity, which corresponds to the operational state of the engine 202 (e.g., the engine rotational speed, the engine load).

The low pressure EGR apparatus 201 recirculates the portion of the exhaust gas from the low exhaust gas pressure area of the exhaust passage 203 to the low negative intake air pressure generating area of the intake air passage 204.

Therefore, although the low pressure EGR apparatus 201 can be effectively used to recirculate the small quantity of the EGR gas to the engine 202, it is difficult to recirculate a large quantity of the EGR gas to the engine 202 through use of the low pressure EGR apparatus 201. That is, even though there is the operational range of the engine 202, at which the large quantity of the EGR gas needs to be recirculated to the engine 202, the low pressure EGR apparatus 201 cannot be used to provide the large quantity of the EGR gas to the engine 202.

It is conceivable to provide an intake air throttle valve 207 (a negative intake air pressure generating valve), which can generate a negative intake air pressure, in the intake air passage 204, to which the low pressure EGR apparatus 201 recirculates the EGR gas. In the operational range of the engine 202, in which the large quantity of the EGR gas should be recirculated to the engine 202, the intake air throttle valve 207 of the low pressure EGR apparatus 201 may possibly be controlled in the valve closing direction thereof (the direction for generating the negative intake air pressure). That is, in the operational range of the engine 202, in which the large EGR quantity should be recirculated to the engine 202, the negative intake air pressure may be generated through the use of the intake air throttle valve 207 to recirculate the large quantity of the EGR gas.

However, as recited above, the opening degree of the low pressure EGR regulating valve 206 is controlled according to the engine rotational speed or the engine load.

The intake air throttle valve 207 is controlled to the valve closing direction only in the operational range, in which the large EGR quantity is demanded by the ECU.

As discussed above, the low pressure EGR regulating valve 206 and the intake air throttle valve 207 are controlled based on the different operational factors, respectively. Therefore, the low pressure EGR regulating valve 206 and the intake air throttle valve 207 are independently operated.

Thus, a dedicated actuator J1, which drives the low pressure EGR regulating valve 206, and a dedicated actuator J2, which drives the intake air throttle valve 207, are required. Therefore, this will possibly result in the cost increase, the size increase and the weight increase.

Thus, in order to reduce the size, the weight and the costs, it has been demanded to drive the low pressure EGR regulating valve 206 and the intake air throttle valve 207 with a single electric actuator (a drive means using, for example, an electric motor).

Therefore, it has been proposed to provide a single electric actuator to drive the low pressure EGR regulating valve 206 and to transmit the output of the single electric actuator to the intake air throttle valve 207 through a link device (a drive force transmitting mechanism).

In such a case, the link device may include a converting mechanism, such as a cam groove, which converts the output (output characteristic) of the electric actuator and transmits the converted output (output characteristic) to the intake air throttle valve 207. In this way, when the opening degree of the low pressure EGR regulating valve 206 becomes larger than a predetermined opening degree, the opening degree of the intake air throttle valve 207 can be reduced (i.e., the negative pressure can be increased) synchronously with the increasing of the opening degree of the low pressure EGR regulating valve 206.

However, in the case where the mechanism of transmitting the output of the electric actuator to the intake air throttle valve 207 through the link device, it is necessary to enable diagnosing of a failure of the intake air throttle valve 207 at the time of occurrence of the failure of the intake air throttle valve 207 caused by a malfunction of the link device (e.g., a malfunction of unintentional disconnection of a cam plate, a malfunction of disengagement of the link).

In view of the above need, it is conceivable to provide an independent valve opening degree sensor, which senses the opening degree of the intake air throttle valve 207 separately from the low pressure EGR regulating valve 206 to determine the failure of the intake air throttle valve 207.

However, the possibility of occurrence of the failure of the intake air throttle valve 207 is very small. Therefore, the provision of the dedicated opening degree sensor to the intake air throttle valve 207 causes a disadvantageous increase in the manufacturing costs, so that the advantage of the cost-effectiveness becomes very low.

SUMMARY OF THE INVENTION

The present invention addresses the above disadvantages. According to the present invention, there is provided a low pressure exhaust gas recirculation apparatus for an internal combustion engine. The internal combustion engine is communicated with an intake air passage, through which intake air is supplied to the internal combustion engine, and an exhaust passage, through which exhaust gas of the internal combustion engine is released to atmosphere. The low pressure exhaust gas recirculation apparatus includes a low pressure exhaust gas recirculation (EGR) flow passage, a low pressure EGR regulating valve, a throttle valve, an electric actuator, a link device, a low pressure EGR opening degree sensor, a low pressure EGR valve return spring, a mechanical stopper and a failure sensing means. The EGR passage is configured to recirculate the exhaust gas as EGR gas from a low exhaust gas pressure area of the exhaust passage to a low negative intake air pressure generating area of the intake air passage. The low pressure EGR regulating valve regulates an opening degree of the low pressure EGR passage to regulate a flow quantity of the EGR gas through the low pressure EGR passage. The throttle valve is adapted to reduce an opening degree of one of the intake air passage and the exhaust passage to increase an EGR flow quantity of the EGR gas in the low pressure EGR passage. The electric actuator drives the low pressure EGR regulating valve. The link device converts an output of the electric actuator to drive the throttle valve. The low pressure EGR opening degree sensor senses an opening degree of the low pressure EGR regulating valve. The low pressure EGR valve return spring urges the low pressure EGR regulating valve in a closing direction thereof for closing the low pressure EGR passage upon stopping of energization of the electric actuator. The mechanical stopper limits a maximum opening degree of the throttle valve. The failure sensing means is for executing a failure determination to determine presence of a failure in a case where a sensed opening degree, which is sensed with the low pressure EGR opening degree sensor, is other than an opening degree that corresponds to a maximum opening degree of the throttle valve limited by the mechanical stopper. The failure sensing means is activated after the energization of the electric actuator is stopped in response to stopping of the internal combustion engine.

BRIEF DESCRIPTION OF THE DRAWINGS

The invention, together with additional objectives, features and advantages thereof, will be best understood from the following description, the appended claims and the accompanying drawings in which:

Figure 1:
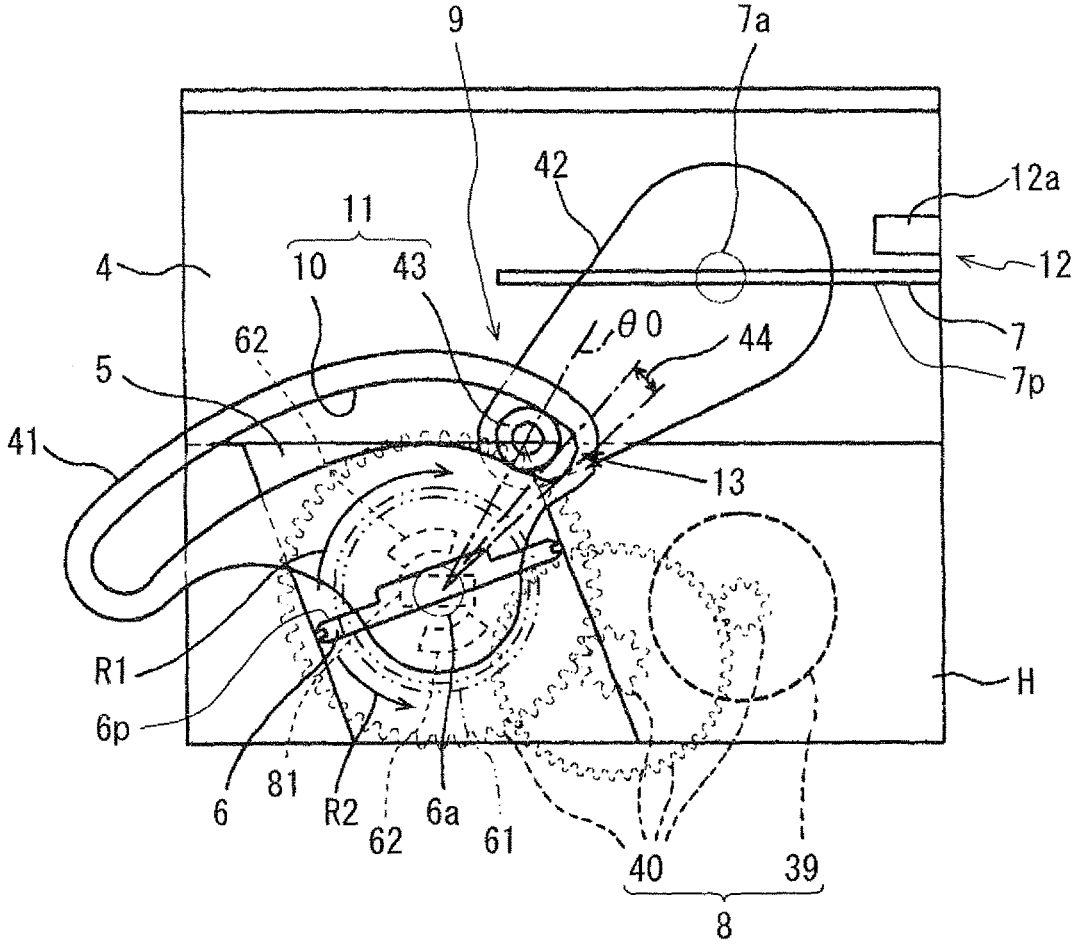
FIG. 1 is a schematic diagram showing a low pressure EGR regulating valve and an intake air throttle valve according to a first embodiment of the present invention.

DETAILED DESCRIPTION OF THE INVENTION (First Embodiment)

A low pressure EGR apparatus 1 according to a first embodiment of the present invention will be described with reference to FIGS. 1 to 6. In the present embodiment as well as the subsequent embodiments, similar components will be indicated by the same reference numerals. Also, any one or more of the components of any one of the following embodiments and modifications thereof may be freely combined with any one or more the components of any other one of the following embodiments and the modifications.

An intake and exhaust system of an internal combustion engine 2 will be described with reference to FIGS. 5 and 6.

The engine 2 of the present embodiment is a diesel engine for generating a drive force of a vehicle. The engine 2 (more specifically, combustion chambers at cylinders of the engine 2) is communicated with an intake air passage 4 and an exhaust passage 3. The intake air passage 4 conducts intake air to cylinders of the engine 2. The exhaust passage 3 conducts exhaust gas generated in the cylinders to the atmosphere.

The intake air passage 4 is formed by passages of an intake air pipe 140, an intake manifold 20 and intake ports.

The intake air pipe 140 is a passage member, which forms a corresponding part of the intake air passage 4 from a fresh air inlet to the intake manifold 20. An air cleaner 21, an air flow meter 22, a compressor (intake air impeller) 23 of a turbocharger, an intercooler 24 and a throttle valve 25 are provided in the intake air pipe 140. The air cleaner 21 filters dusts and other contaminants from the intake air, which is drawn toward the engine 2. The air flow meter 22 measures an intake air flow quantity. The intercooler 24 forcefully cools the intake air, which has been compressed to a high pressure state by the compressor 23 and has been thereby heated to a high temperature state. The throttle valve 25 adjusts the quantity of the intake air flow, which is drawn into the cylinders.

The intake manifold 20 is a distributing pipe unit having branched pipes, which distribute the intake air supplied from the intake air pipe 140 to the cylinders of the engine 2. A surge tank 26 is placed in the interior of the intake manifold 20 to limit an intake air pressure pulsation and an intake air interference, which would have negative influences on the accuracy of the flow quantity sensor.

At a cylinder head of the engine 2, the intake ports are provided to the cylinders, respectively, to guide the intake air distributed by the intake manifold 20 to the cylinders.

The exhaust passage 3 is formed by passages of exhaust ports, an exhaust manifold 30 and an exhaust pipe 130.

Similar to the intake ports, at the cylinder head of the engine 2, the exhaust ports are provided to the cylinders, respectively, to guide the exhaust gas generated in the cylinder to the exhaust manifold 30.

The exhaust manifold 30 is a collecting tube unit having branched tubes for collecting the exhaust gas discharged from the respective exhaust ports. An exhaust turbine 27 (exhaust impeller) of the turbocharger is placed at a connection between an exhaust outlet of the exhaust manifold 30 and the exhaust pipe 130.

The exhaust pipe 130 is a passage member, which releases the exhaust gas passed through the exhaust turbine 27 to the atmosphere. A diesel particulate filter (DPF) 28, exhaust temperature sensors 29 and a differential pressure sensor are provided in the exhaust pipe 130. The DPF 28 collects particulates contained in the exhaust gas. The exhaust temperature sensors 29 sense the temperature of the exhaust gas on the upstream side of the DPF 28 and the temperature of the exhaust gas on the downstream side of the DPF 28. The differential pressure sensor senses a pressure difference between the upstream side and the downstream side of the DPF 28.

At the cylinder head, in which the intake ports and the exhaust ports are formed, intake valves and exhaust valves are provided. Each intake valve opens and closes an outlet end of the intake port of the corresponding cylinder (a boundary between the intake port and the interior of the cylinder).

An intake stroke, a compression stroke, a combustion and expansion stroke and an exhaust stroke are repeated in each cylinder of the engine 2. The intake valve is opened at the beginning of the intake stroke (at the start of increasing of the cylinder volume caused by a downward movement of a piston). The intake valve is closed at the end of the intake stroke (at the end of the increasing of the cylinder volume caused by the downward movement of the piston). The flow of the intake air, which is directed from the fresh air inlet toward the cylinders of the engine 2, is created by the intake stroke of the engine 2.

Similarly, the exhaust valve is opened at the beginning of the exhaust stroke (at the start of decreasing of the cylinder volume caused by an upward movement of the piston). The exhaust valve is closed at the end of the exhaust stroke (at the end of the decreasing of the cylinder volume caused by the upward movement of the piston). The flow of the exhaust gas, which is directed from the cylinder interior of the engine 2 to an atmosphere side opening (exhaust gas outlet), is created by the exhaust stroke of the engine 2.

Figure 5:
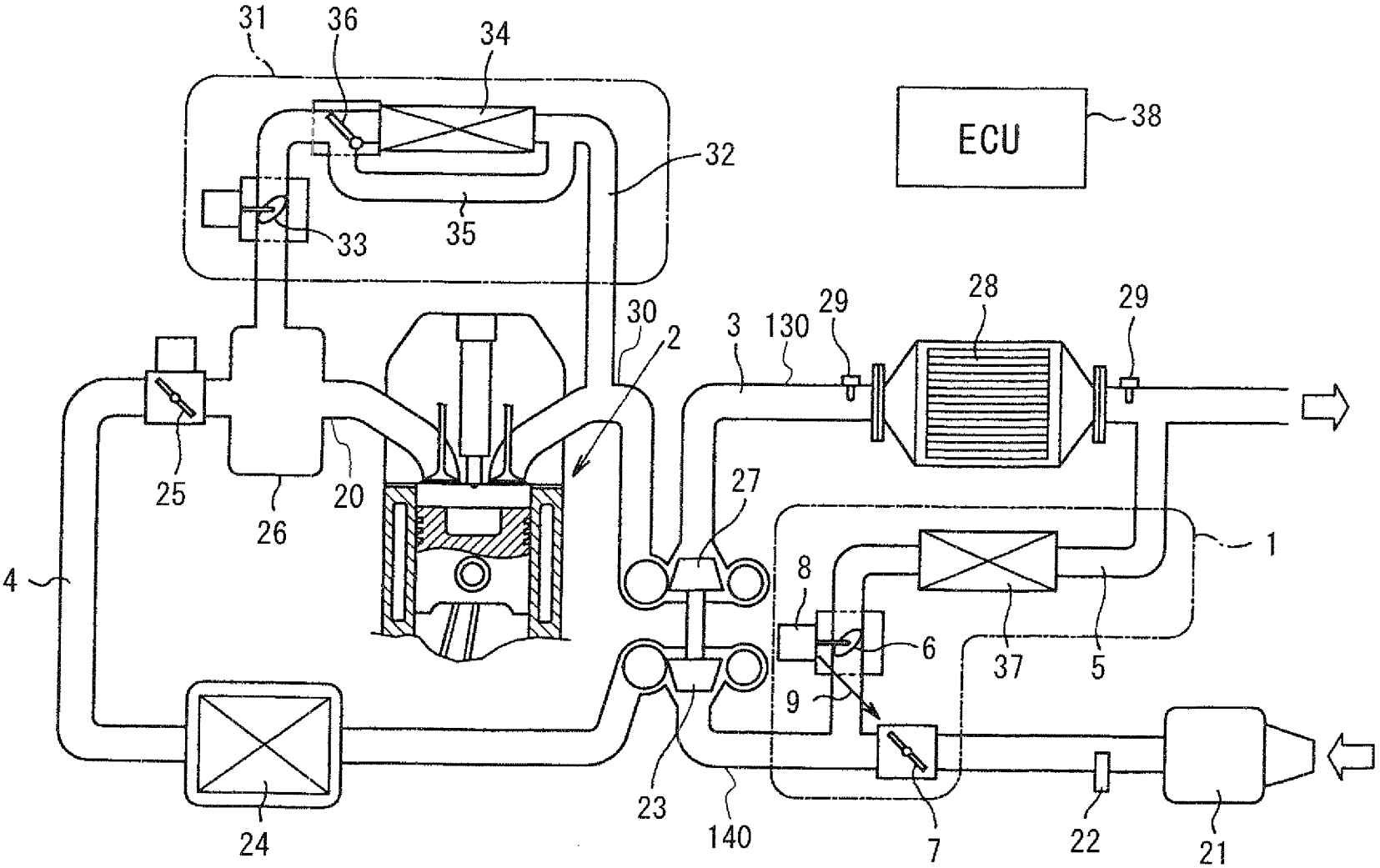
FIG. 5 is a schematic diagram of an intake and exhaust system of an internal combustion engine according to the first embodiment.

In the intake and exhaust system of the engine 2 shown in FIG. 5, a high pressure EGR apparatus 31 and the low pressure EGR apparatus 1 are provided.

The high pressure EGR apparatus 31 is an exhaust gas recirculation apparatus that connects between an interior part of the exhaust passage 3 at a high exhaust gas pressure area (an area of the exhaust passage 3, which is located on the upstream side of the DPF 28 in the exhaust gas flow direction and at which the high exhaust gas pressure is generated) and an interior part of the intake air passage 4 at a high negative intake air pressure generating area (an area of the intake air passage 4, which is located on the downstream side of the throttle valve 25 in the intake air flow direction and at which the high intake air pressure is generated) to recirculate a large quantity of the exhaust gas to the engine 2. The high pressure EGR apparatus 31 includes a high pressure EGR passage 32, through which a portion of the exhaust gas is recirculated to the downstream side part of the intake air passage 4. Specifically, an exhaust passage 3 side part (inlet) of the high pressure EGR passage 32 is connected to the exhaust manifold 30, and an intake air passage 4 side part (outlet) of the high pressure EGR passage 32 is connected to the surge tank 26 of the intake manifold 20.

A high pressure EGR regulating valve 33, a high pressure EGR cooler 34, a high pressure cooler bypass passage 35 and a high pressure EGR cooler change valve 36 are provided in the high pressure EGR passage 32. The high pressure EGR regulating valve 33 regulates the flow quantity of the EGR gas by adjusting an opening degree of the high pressure EGR passage 32. The high pressure EGR cooler 34 cools the EGR gas, which is recirculated to the intake air passage 4 side. The high pressure cooler bypass passage 35 conducts the EGR gas to be recirculated to the intake air passage 4 side while bypassing the high pressure EGR cooler 34. The high pressure EGR cooler change valve 36 changes the flow of the EGR gas between the high pressure EGR cooler 34 and the high pressure cooler bypass passage 35.

It is desirable that the high pressure EGR regulating valve 33, the high pressure EGR cooler 34, the high pressure cooler bypass passage 35 and the high pressure EGR cooler change valve 36 are integrally assembled as a high pressure EGR module, which is then installed to the vehicle. However, the present invention is not limited to this construction. For example, the high pressure EGR regulating valve 33, the high pressure EGR cooler 34, the high pressure cooler bypass passage 35 and the high pressure EGR cooler change valve 36 may be individually separately installed to the vehicle.

The low pressure EGR apparatus 1 is an exhaust gas recirculation apparatus that connects between a low exhaust gas pressure area of the exhaust passage 3 and a low negative intake air pressure generating area of the intake air passage 4 to recirculate a small quantity of the exhaust gas to the engine 2 with a high accuracy. The low exhaust gas pressure area of the exhaust passage 3 is an area of the exhaust passage 3, which is located on the downstream side of the DPF 28 in the exhaust gas flow direction and at which the low exhaust gas pressure is generated. The low negative intake air pressure generating area of the intake air passage 4 is an area of the intake air passage 4, which is located on the upstream side of the throttle valve 25 in the intake air flow direction and at which the low negative intake air pressure is generated. The low pressure EGR apparatus 1 includes a low pressure EGR passage 5, through which a portion of the exhaust gas is recirculated to the upstream side part of the intake air passage 4. Specifically, an exhaust passage 3 side part (inlet) of the low pressure EGR passage 5 is connected to the portion of the exhaust pipe 130, which is located on the downstream side of the DPF 28 in the exhaust gas flow direction, and an intake air passage 4 side part (outlet) of the low pressure EGR passage 5 is connected to the portion of the intake air pipe 140, which is located on the upstream side of the compressor 23 of the turbocharger in the intake air flow direction.

A low pressure EGR regulating valve 6 and a low pressure EGR cooler 37 are provided in the low pressure EGR passage 5. The low pressure EGR regulating valve 6 regulates the flow quantity of the EGR gas by regulating an opening degree of the low pressure EGR passage 5. The low pressure EGR cooler 37 cools the EGR gas, which is recirculated to the intake air passage 4 side.

An intake air throttle valve 7 (a negative intake air pressure generating valve) is provided on the upstream side of the connection of the low pressure EGR passage 5, which is connected to the intake air pipe 140. The intake air throttle valve 7 is provided to generate the negative intake air pressure at the connection of the low pressure EGR passage 5, which is connected to the intake air pipe 140. The intake air throttle valve 7 is constructed to partially open the intake air passage 4 even in a maximum closed state of the intake air throttle valve 7, at which the opening degree of the intake air passage 4 is reduced to a maximum level (i.e., having a minimum opening degree of the intake air throttle valve 7). Specifically, even when the intake air throttle valve 7 reduces the opening degree of the intake air passage 4 at its maximum level, for instance, 10% of the cross-sectional area of the intake air passage 4 is left opened (see the minimum flow quantity indicated by a solid line Y in FIG. 2).

It is desirable that the low pressure EGR regulating valve 6, the intake air throttle valve 7 and the low pressure EGR cooler 37 are integrally assembled as a low pressure EGR module, which is then installed to the vehicle. However, the present invention is not limited to this construction. For example, the low pressure EGR regulating valve 6, the intake air throttle valve 7 and the low pressure EGR cooler 37 may be individually separately installed to the vehicle.

Here, the high pressure EGR cooler 34 and the low pressure EGR cooler 37 are cooling devices of a liquid-cooled type (a water-cooled type), each of which cools the high temperature EGR gas by exchanging the heat between the engine coolant of the engine 2 and the high temperature EGR gas and thereby includes a heat exchanger that exchanges the heat between the engine coolant and the EGR gas.

Next, an engine control unit (ECU) 38, which controls the high pressure EGR apparatus 31 and the low pressure EGR apparatus 1, will be described.

The ECU 38 executes opening degree control operations (including valve switching control operations) for controlling opening degrees of the high pressure EGR regulating valve 33 and the high pressure EGR cooler change valve 36 of the high pressure EGR apparatus 31 and the low pressure EGR regulating valve 6 and the intake air throttle valve 7 of the low pressure EGR apparatus 1.

The ECU 38 has a microcomputer of a known structure, which includes a CPU, a storage device (a memory such as a ROM, a RAM), an input circuit and an output circuit. The CPU executes control processes and computing processes. The storage device stores various programs and data.

The ECU 38 controls the operation of the engine 2 (e.g., fuel injections at the engine 2) based on the control programs stored in the storage device and the various sensor signals (e.g., manipulation signals generated by manipulation operations of the occupant of the vehicle, and sensor singles). The storage device of the ECU 38 stores the EGR control programs for controlling the operations of the high pressure EGR apparatus 31 and the low pressure EGR apparatus 1.

The EGR control programs include a high pressure EGR cooler change program and a high pressure and low pressure EGR quantity control program. The high pressure EGR cooler change program changes the opening degree of the high pressure EGR cooler change valve 36 based on an warming-up state of the engine 2 (e.g. the temperature of the engine coolant). The high pressure and low pressure EGR quantity control program controls the opening degrees of the high pressure EGR regulating valve 33, the low pressure EGR regulating valve 6 and the intake air throttle valve 7 based on the engine rotational speed and the engine load (the engine torque).

The high pressure and low pressure EGR quantity control program will be schematically described with reference to FIG. 6.

The high pressure and low pressure EGR quantity control program executes the following procedures (i) to (iii).

Figure 6:
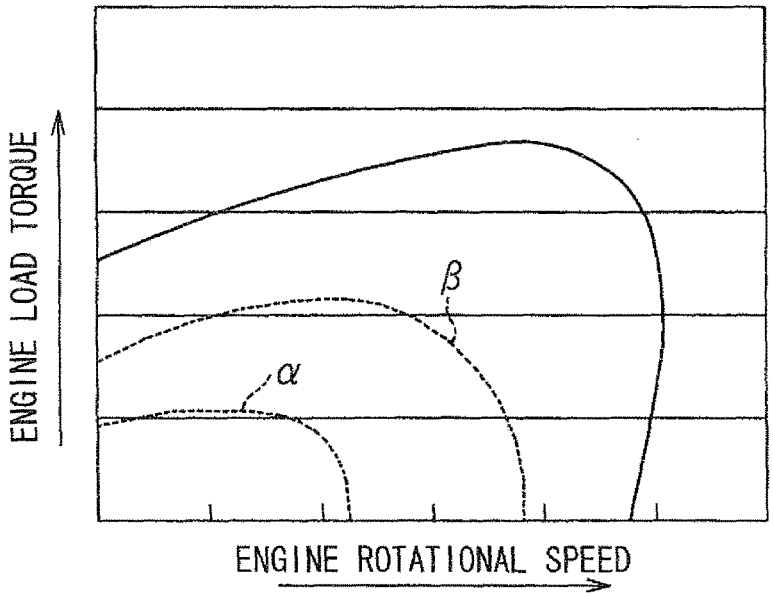
FIG. 6 is a diagram showing an EGR control operation conducted upon execution of a high pressure and low pressure EGR quantity control program according to the first embodiment.

(i) The high pressure and low pressure EGR quantity control program stops the low pressure EGR apparatus 1 and executes the EGR control operation by controlling only the opening degree of the high pressure EGR regulating valve 33 of the high pressure EGR apparatus 31 (specifically, closing the low pressure EGR passage 5 with the low pressure EGR regulating valve 6 and controlling the opening degree of the high pressure EGR regulating valve 33 according to the relationship between the engine rotational speed and the engine torque) in an operational range (i.e., an engine operational range defined by the relationship between the engine rotational speed and the engine torque), which is equal to or below dotted line α in FIG. 6.

(ii) The high pressure and low pressure EGR quantity control program executes the EGR control operaion by controlling the opening degree of the high pressure EGR regulating valve 33 of the high pressure EGR, apparatus 31 and the opening degrees of the low pressure EGR regulating valve 6 and the intake air throttle valve 7 of the low pressure EGR apparatus 1 (specifically, controlling the opening degree of the high pressure EGR regulating valve 33 according to the relationship between the engine rotational speed and the engine torque and controlling the opening degrees of the low pressure EGR regulating valve 6 and the intake air throttle valve 7 according to the relationship between the engine rotational speed and the engine torque) in an operational range between the dotted line a and a dotted line β in FIG. 6.

(iii) The high pressure and low pressure EGR quantity control program stops the high pressure EGR apparatus 31 and executes the EGR control operation by controlling only the opening degrees of the low pressure EGR regulating valve 6 and the intake air throttle valve 7 of the low pressure EGR apparatus 1 (specifically, closing the high pressure EGR passage 32 with the high pressure EGR regulating valve 33 and controlling the opening degrees of the low pressure EGR regulating valve 6 and the intake air throttle valve 7 according to the relationship between the engine rotational speed and the engine torque) in an operational range equal to or above the dotted line β in FIG. 6.

The low pressure EGR apparatus 1 is configured to recirculate the EGR gas from the low exhaust gas pressure area to the low negative intake air pressure generating area, so that the low pressure EGR apparatus 1 can recirculate the small quantity of the EGR gas to the engine 2 with a high accuracy. However, in a particular operational range of the engine 2, in which the large quantity of the EGR gas needs to be recirculated to the engine 2 through the low pressure EGR apparatus 1, it is difficult to recirculate the large quantity of the EGR gas to the engine 2 through the low pressure EGR apparatus 1, which is configured to recirculate the EGR gas to the low negative intake air pressure generating area.

In view of this, the low pressure EGR apparatus 1 has the intake air throttle valve 7, which is configured to actively generate the negative intake air pressure in the intake air passage 4, which recirculates the EGR gas. In the operational range, in which the large quantity of the EGR gas needs to be provided in the low pressure EGR apparatus 1, the valve opening degree control operation of the intake air throttle valve 7 is executed to drive the intake air throttle valve 7 in a valve closing direction thereof (a direction of closing the intake air throttle valve 7, i.e., a direction for generating the negative intake air pressure) to control the large quantity of the EGR gas in the low pressure EGR apparatus 1.

However, the intake air throttle valve 7 needs to be operated as follows. That is, at the time of recirculating the small quantity of the EGR gas to the engine 2 through the low pressure EGR apparatus 1 (the low EGR gas concentration control state), the intake air throttle valve 7 needs to be fixed to the maximum opening degree (the full opening degree) of the intake air throttle valve 7 to limit the generation of the negative pressure, and only the opening degree of the low pressure EGR regulating valve 6 needs to be controlled. Furthermore, at the time of recirculating the large quantity of the EGR gas to the engine 2 through the low pressure EGR apparatus 1 (the high EGR gas concentration control state), the opening degree of the low pressure EGR regulating valve 6 needs to be increased, and the valve opening degree of the intake air throttle valve 7 needs to be reduced to increase the negative pressure.

Figure 11:
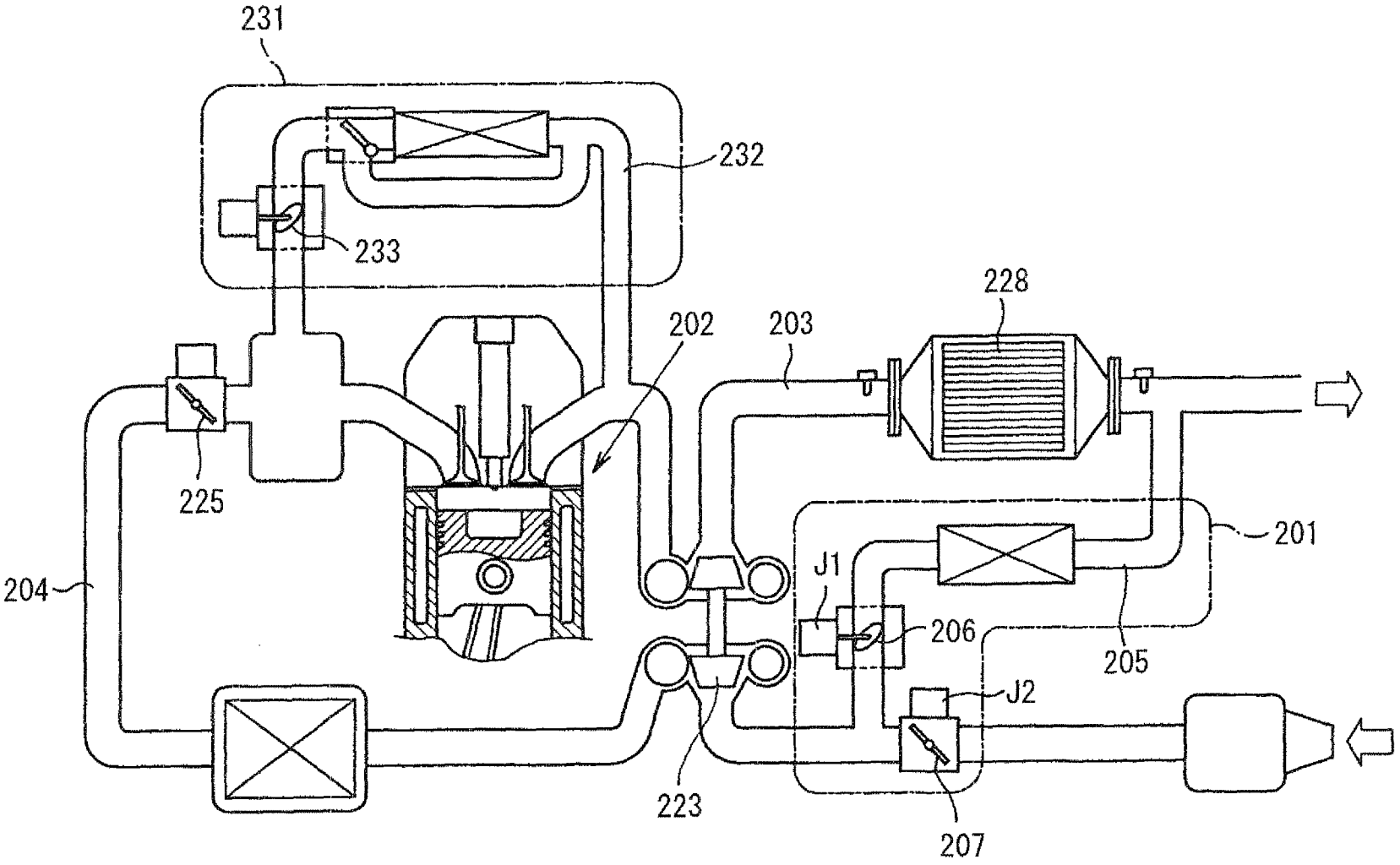
FIG. 11 RELATED ART
FIG. 11 is a schematic diagram of an intake and exhaust system of an internal combustion engine according to another previously proposed technique.

As described above, in the low EGR gas concentration control state, the opening degree of the intake air throttle valve 7 is fixed at the full opening degree, and only the opening degree of the low pressure EGR regulating valve 6 is controlled. In the high EGR gas concentration state, the opening degree of the intake air throttle valve 7 is changed according to the opening degree of the low pressure EGR regulating valve 6. Therefore, in the previously proposed technique, the dedicated actuator J1 (see FIG. 11), which drives the low pressure EGR regulating valve 206, and the dedicated actuator J2 (see FIG. 11), which drives the intake air throttle valve 207, are required, thereby possibly resulting in the increased manufacturing costs, the increased size and the increased weight.

In view of the above disadvantages, as shown in FIG. 1, the low pressure EGR apparatus 1 of the first embodiment includes an electric actuator 8 and a link device 9. The electric actuator 8 drives the low pressure EGR regulating valve 6. The link device 9 converts the output (output characteristic) of the electric actuator 8 and drives the intake air throttle valve 7 with the converted output of the electric actuator 8. The intake air throttle valve 7 is driven by the output of the electric actuator 8, which is transmitted through the link device 9.

The link device 9 includes a converting arrangement (characteristic converting arrangement) 11. The converting arrangement 11 includes a cam groove 10 and converts the output (output characteristic) of the electric actuator 8 and transmits it to the intake air throttle valve 7. When the opening degree of the low pressure EGR regulating valve 6 becomes larger than a predetermined opening degree, the link device 9 reduces the opening degree of the intake air throttle valve 7 synchronously with the increase in the opening degree of the low pressure EGR regulating valve 6 (see FIG. 2).

Figure 2:
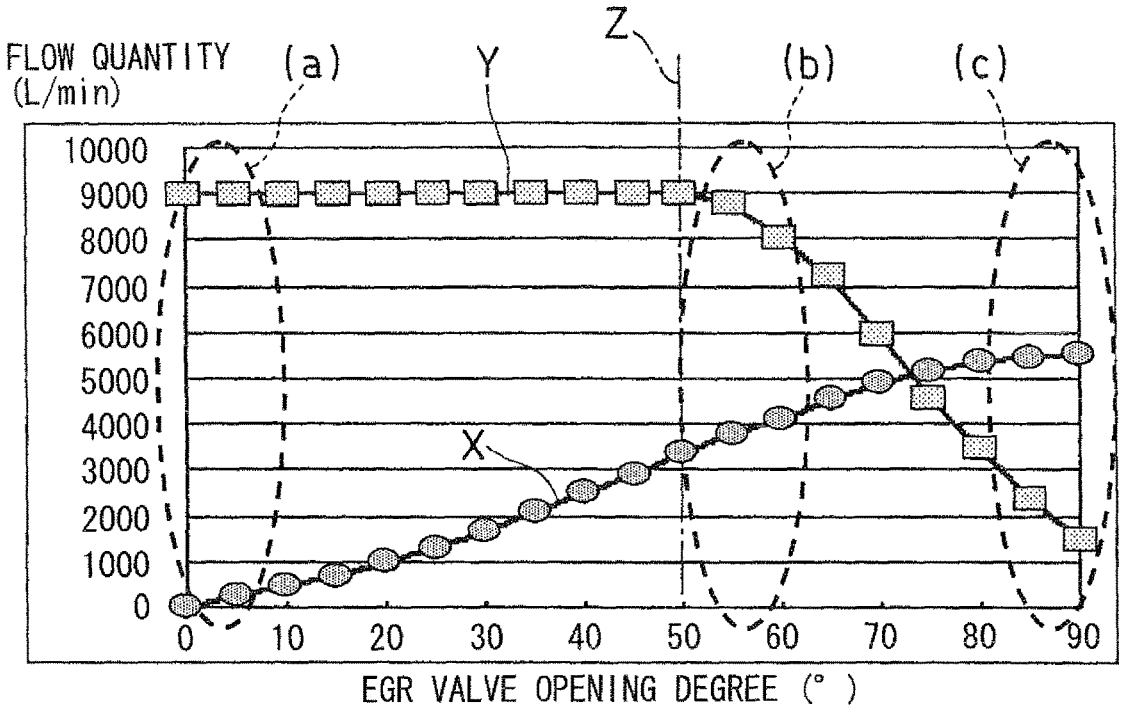
FIG. 2 is a diagram showing a relationship between an EGR flow quantity and an intake air quantity with respect to a rotational angle of the low pressure EGR regulating valve of the first embodiment.

A solid line X in FIG. 2 indicates a change in the EGR flow quantity relative to the rotational angle of the low pressure EGR regulating valve 6. A solid line Y in FIG. 2 indicates a change in the intake air flow quantity, which is implemented by the intake air throttle valve 7, relative to the rotational angle of the low pressure EGR regulating valve 6.

Figure 3A:
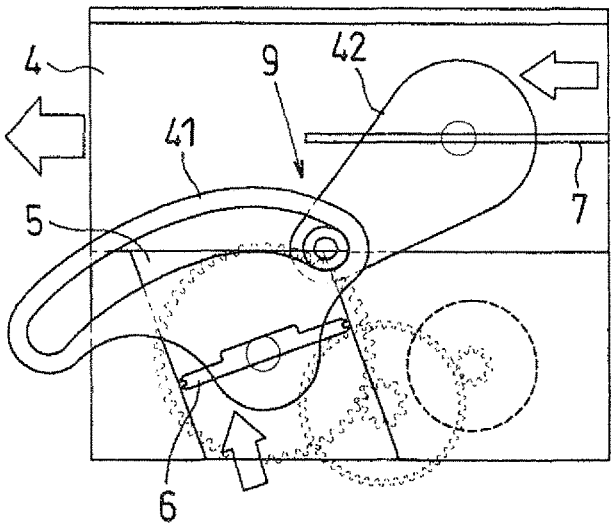
FIGS. 3A to 3C are schematic diagrams showing various operational states of the low pressure EGR regulating valve and the intake air throttle valve of the first embodiment.
Figure 3B:
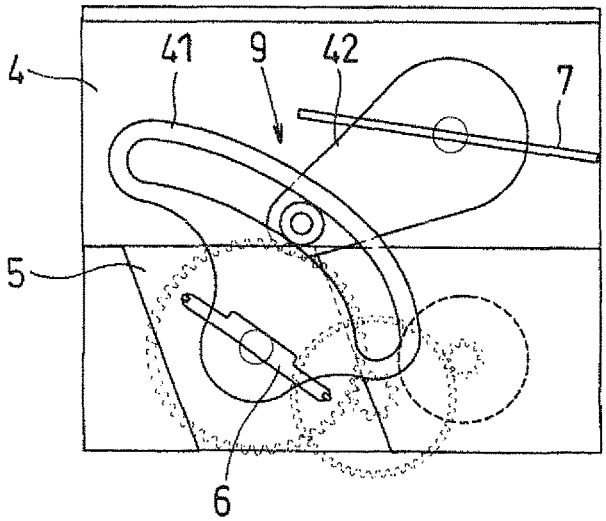
Figure 3C:
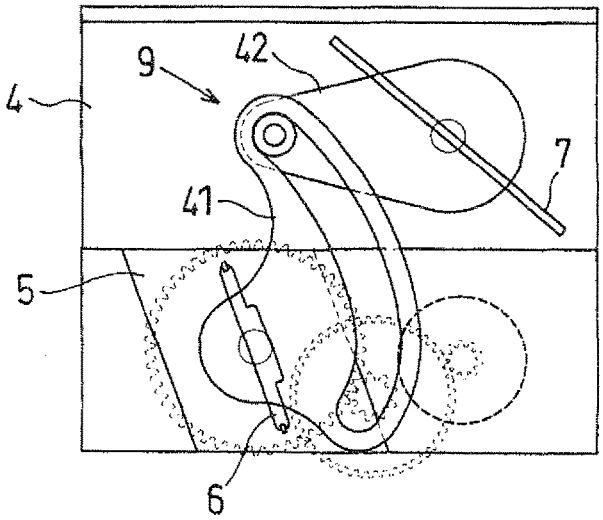

FIG. 3A shows an operational state, in which the rotational angle of the low pressure EGR regulating valve 6 is at or around 0 (zero) degrees (the full closed position of the low pressure EGR regulating valve 6). This operational state of FIG. 3A is indicated by a dotted line a in FIG. 2. FIG. 3B shows another operational state, in which the rotational angle of the low pressure EGR regulating valve 6 is at or around a predetermined change opening degree Z (the rotational position, at which the intake air throttle valve 7 begins the throttling). This operational state of FIG. 3B is indicated by a dotted line b in FIG. 2. FIG. 3C shows another operational state, in which the rotational angle of the low pressure EGR regulating valve 6 is at or around 90 degrees (the full open position of the intake air throttle valve 7). This operational state of FIG. 3C is indicated by a dotted line c in FIG. 2.

That is, the state from FIG. 3A to FIG. 3B is the low EGR gas concentration control state, and the state from FIG. 3B to FIG. 3C is the high EGR gas concentration control state.

Next, a specific example of the key feature of the low pressure EGR apparatus 1 will be described.

The low pressure EGR regulating valve 6 regulates the opening degree of the low pressure EGR passage 5 through the rotational displacement (rotational movement) of the low pressure EGR regulating valve 6. The intake air throttle valve 7 regulates the opening degree of the intake air passage 4 through the rotational displacement (rotational movement) of the intake air throttle valve 7. A valve plate 6*p* of the low pressure EGR regulating valve 6 is fixed to an EGR valve support shaft 6*a*, and a valve plate 7*p* of the intake air throttle valve 7 is fixed to a throttle valve support shaft 7*a*. The EGR valve support shaft 6*a* and the throttle valve support shaft 7*a* are generally parallel to each other. Specifically, the EGR valve support shaft 6*a* and the throttle valve support shaft 7*a* are rotatably supported by a passage forming member H (a housing), which forms the low pressure EGR passage 5, through bearings. Therefore, the rotational axis of the low pressure EGR regulating valve 6 and the rotational axis of the intake air throttle valve 7 are generally parallel to each other.

The electric actuator 8 is fixed to the passage forming member H. The electric actuator 8 drives the EGR valve support shaft 6*a* to rate the same. Furthermore, the electric actuator 8 drives the throttle valve support shaft 7*a* through the link device 9 to rotate the throttle valve support shaft 7*a*.

Furthermore, the electric actuator 8 shown in FIG. 1 includes an electric motor 39 and a speed reducing mechanism 40 (e.g., a speed reducing gear mechanism). The electric motor 39 generates the rotational output upon energization of the same. The speed reducing mechanism 40 transmits the rotation to the electric motor 39 to the EGR valve support shaft 6*a* upon reducing the rotational speed of the electric motor 39. Specifically, in the first embodiment, the electric motor 39 is implemented as a direct current (DC) electric motor, a rotational angle of which is controllable according to the amount of electric power supplied thereto.

The link device 9 converts the output (the output characteristic, such as the rotational characteristic) of the electric actuator 8 through the converting arrangement 11 to drive the intake air throttle valve 7. The link device 9 includes a cam plate 41 and a driven-side arm 42. The cam plate 41 is rotatable integrally with the EGR valve support shaft 6*a*. The driven-side arm 42 is rotatable integrally with the throttle valve support shaft 7*a*.

The cam plate 41 is configured into a plate form and is made of a material that is highly wear resistant (e.g., nylon resin). The cam plate 41 is fixed to the EGR valve support shaft 6*a* such that a plane of the cam plate 41 is generally perpendicular to the EGR valve support shaft 6*a*.

The driven arm 42 is configured into a plate form having a small width and is made of a material that is highly wear resistant (e.g., nylon resin). The driven-side arm 42 is fixed to the throttle valve support shaft 7*a* such that a plane of the driven-side arm 42 is generally perpendicular to the throttle valve support shaft 7*a*, and a rotatable end part of the driven-side arm 42 overlaps with the cam plate 41 while a predetermined gap is formed between the rotatable end part of the driven-side arm 42 and the cam plate 41.

In the link device 9, the converting arrangement 11, which converts the output (output characteristic) of the electric actuator 8, includes the cam groove 10 and a driven-side pin 43. The cam groove 10 is formed in the cam plate 41 at a location, which is radially outwardly spaced from the rotational center of the cam plate 41. The driven-side pin 43 is fitted into the cam groove 10. The driven-side pin 43 includes a shaft, which is fixed to the rotatable end part of the driven-side arm 42, and a roller (a rotational difference absorbing body), which is rotatably fitted to an outer peripheral surface of the shaft. The shaft, which supports the roller, may be formed integrally with the driven-side arm 42. Alternatively, the shaft may be formed separately from the driven-side arm 42 and may be fixed to the driven-side arm 42 later.

A cam profile of the cam groove 10, which provides the drive force to the driven-side pin 43, is formed by a combination of two groove sections of different shapes.

One of the two groove sections of the cam groove 10 is an arcuate groove section that has a center of its arc at the rotational axis of the cam plate 41. This groove section is configured to maintain the maximum opening degree of the intake air throttle valve 7 in a valve closing side opening degree range of the low pressure EGR regulating valve 6 that is from a maximum throttling angle (the EGR side rotational angle=0 degrees in FIG. 2), at which the low pressure EGR passage 5 is throttled at the maximum degree, to a predetermined change opening degree Z (i.e., the angular range from −10 degrees to the predetermined change opening degree Z through 0 degrees).

The other one of the two groove sections of the cam groove 10 is a groove section, which changes at predetermined angle relative to the arcuate groove section that has the center of the arc at the rotational axis of the cam plate 41. In other words, the other one of the two groove sections is an arcuate groove, which has a larger radius of curvature (i.e., an arcuate groove or a curved groove closer to a straight line) in comparison to the arcuate groove section that has the center of the arc at the rotational axis of the cam plate 41 in FIG. 1. When the opening degree of the low pressure EGR regulating valve 6 changes from the predetermined change opening degree Z to the maximum opening degree (the EGR side rotational angle=90 degrees in FIG. 2), it drives the driven-side arm 42 to rotate the same to change the opening degree of the intake air throttle valve 7 from the maximum opening degree in the closing direction for closing the intake air passage 4.

In the case where the output of the electric actuator 8 is transmitted to the intake air throttle valve 7 through the link device 9, it is necessary to diagnose a failure of the intake air throttle valve 7 at the time of occurrence of the failure of the intake air throttle valve 7 caused by the malfunction of the link device 9 (e.g., the malfunction of unintentional disconnection (unintentional removal) of the cam plate 41 or the driven-side arm 42 caused by, for example, loosening of a fixing nut, the malfunction of unintentional disengagement between the cam groove 10 and the driven-side pin 43, and/or the malfunction of unintentional fastening (sticking) between the cam groove 10 and the driven-side pin 43).

In view of the above need, it is conceivable to provide an independent valve opening degree sensor, which senses the opening degree of the intake air throttle valve 7 separately from the low pressure EGR regulating valve 6 to determine the failure of the intake air throttle valve 7.

However, the possibility of occurrence of the intake air throttle valve 7 is very small. Therefore, the provision of the dedicated opening degree sensor to the intake air throttle valve 7 causes a disadvantageous increase in the manufacturing costs, so that the advantage of the cost-effectiveness becomes very low.

Now, the characteristic technical features of the first embodiment will be described.

The low pressure EGR apparatus 1 of the first embodiment adapts the following technique in view of the above points.

As discussed above, the low pressure EGR apparatus 1 includes:

the low pressure EGR passage 5, which is configured to recirculate the exhaust gas as EGR gas from the low exhaust gas pressure area of the exhaust passage 3 to the low negative intake air pressure generating area of the intake air passage 4;

the low pressure EGR regulating valve 6, which regulates the opening degree of the low pressure EGR passage 5 to regulate the flow quantity of the EGR gas through the low pressure EGR passage 5;

the intake air throttle valve 7, which is adapted to change the opening degree of the intake air passage 4 on the upstream side of the connection between the intake air passage 4 and the low pressure EGR passage 5;

the single electric actuator 8, which drives the low pressure EGR regulating valve 6; and the link device 9, which converts the output of the electric actuator 8 to drive the throttle valve 7.

In addition, the low pressure EGR apparatus 1 further includes:

the low pressure EGR opening degree sensor (specifically, permanent magnets 62 and a magnetic sensor 81 described below in detail), which senses the opening degree of the low pressure EGR regulating valve 6;

the low pressure EGR valve return spring 61, which urges the low pressure EGR regulating valve 6 in the closing direction thereof for closing the low pressure EGR passage 5 upon stopping of the energization of the electric actuator 8;

the valve side mechanical stopper 12 (or the link side mechanical stopper 13), which limits the maximum opening degree of the intake air throttle valve 7 through member-to-member abutment; and the failure sensing means (the ECU 38) for executing the failure determination to determine presence of the failure in the case where the sensed opening degree, which is sensed with the low pressure EGR opening degree sensor, is other than the opening degree that corresponds to the maximum opening degree of the intake air throttle valve 7 limited by the valve side mechanical stopper 12 (or the link side mechanical stopper 13), wherein the failure sensing means is activated after the energization of the electric actuator 8 is stopped in response to stopping of the engine 2.

The exhaust gas pressure in the low exhaust gas pressure area of the exhaust passage 3 is smaller (weaker) than that of the high exhaust gas pressure area of the exhaust passage 3, which is located at the location (the interior of the exhaust manifold 30) adjacent to the exhaust ports of the cylinders of the engine 2, when the engine 2 is running. The negative intake air pressure in the low negative intake air pressure generating area of the intake air passage 4 is smaller (weaker) than that of the high negative intake air pressure generating area of the intake air passage 4, which is located at the location (the interior of the surge tank 26 of the intake manifold 20) adjacent to the intake ports of the cylinders, when the engine 2 is running.

Now, the above limitations of the low pressure EGR apparatus 1 will be described in detail.

As discussed above, the low pressure EGR opening degree sensor senses the opening degree of the low pressure EGR regulating valve 6 and is placed at one axial end part of the EGR valve support shaft 6*a*.

Specifically, the low pressure EGR opening degree sensor of the present embodiment includes the permanent magnets 62 and the magnetic sensor (e.g., the Hall IC) 81. The permanent magnets 62 are fixed to one of members, which are rotatable relative to each other. For instance, the permanent magnets 62 may be fixed to the rotatable member, which is rotated integrally with the EGR valve support shaft 6*a*. The magnetic sensor 81 is fixed to the other one of the above members, which are rotatable relative to each other. For instance, the magnetic sensor 81 may be fixed to the stationary member, such as a cover case. The low pressure EGR opening degree sensor senses the rotational angle of the EGR valve support shaft 6*a* based on a change in a magnetic flux applied from the magnets 62 to the magnetic sensor 81. The sensed result (the output of the Hall IC) is outputted to the ECU 38.

A low pressure EGR valve return spring 61 is a helical torsion spring that is placed at the axial end part of the EGR valve support shaft 6*a*, at which the low pressure EGR opening degree sensor (specifically, the magnets 62 and the magnetic sensor 81) is located. The low pressure EGR valve return spring 61 exerts an urging force against the axial end part of the EGR valve support shaft 6*a* to urge the low pressure EGR regulating valve 6 in the valve closing direction thereof. When the energization of the electric actuator 8 is stopped upon stopping of the engine 2, the low pressure EGR valve return spring 61 returns the low pressure EGR regulating valve 6 toward the valve closing position thereof through use of the restoring force of the helical torsion spring.

The valve side mechanical stopper 12 limits the maximum opening degree of the intake air throttle valve 7 through abutment (member-to-member abutment) between the intake air throttle valve 7 and a projection 12*a*, which is placed in the intake air passage 4.

Alternatively, the valve side mechanical stopper 12 may be eliminated. In such a case, an end part of the cam groove 10 (an overturn side end part of the cam groove 10 described later) and the driven-side pin 43 mechanically abut with each other at the maximum opening degree side of the intake air throttle valve 7 to limit the maximum opening degree of the intake air throttle valve 7, thereby serving as the link side mechanical stopper 13. Therefore, the link side mechanical stopper 13 may be used to implement the member-to-member abutment while the valve side mechanical stopper 12 is eliminated.

The failure sensing means is the part of the control program, which is executed by the ECU 38. The failure sensing means includes a link failure sensing program and an intake air defect sensing program. The link failure sensing program is executable to sense presence of the failure of the intake air throttle valve 7 based on the sensed opening degree of the low pressure EGR opening degree sensor after the stopping of the engine 2. The intake air defect sensing program is executable to sense the presence of the failure of the intake air throttle valve 7 based on the intake air state (a shortage of the supercharge and/or the intake air flow quantity) of the intake air supplied to the engine 2 during the running state of the engine 2.

Figure 4:
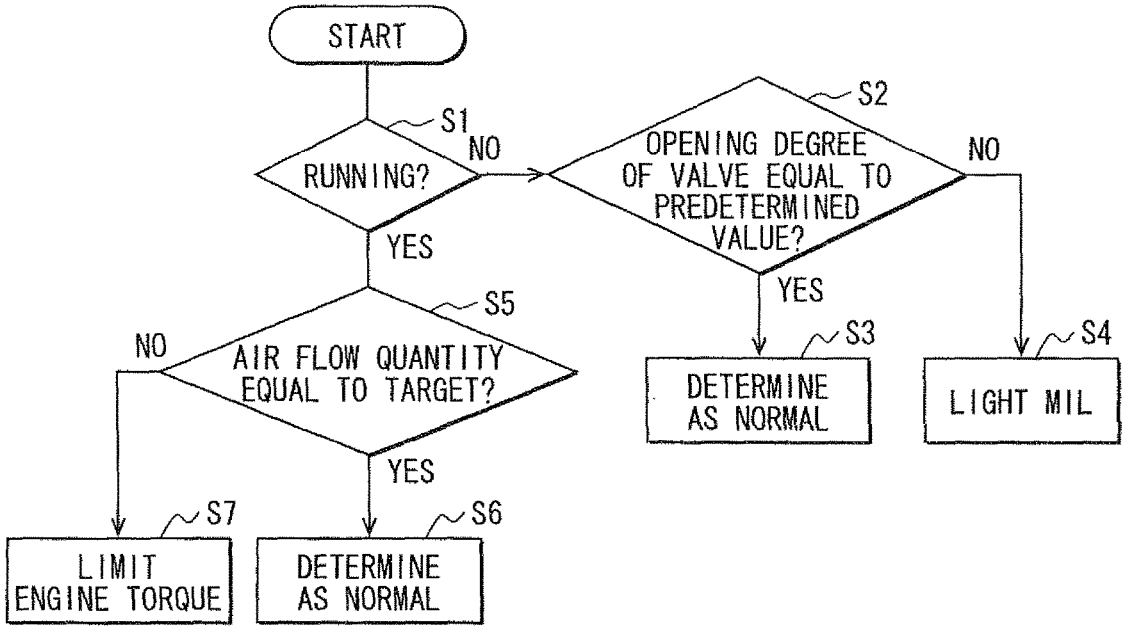
FIG. 4 is a flowchart showing an failure detection operation according to the first embodiment.

The link failure sensing program and the intake air defect sensing program will be described with reference to FIG. 4.

When this control routine starts, the operation proceeds to step S1. At step S1, it is determined whether the engine 2 is running (i.e., the vehicle is traveling).

When the answer to the inquiry at step S1 is NO (i.e., the engine 2 being stopped), the operation proceeds to step S2. At step S2, it is determined whether the sensed opening degree, which is sensed with the low pressure EGR opening degree sensor, is the corresponding opening degree (predetermined value) that corresponds to the maximum opening degree of the intake air throttle valve 7, which is limited by the valve side mechanical stopper 12, i.e., it is determined whether the sensed opening degree of the low pressure EGR opening degree sensor is equal to or lower than 0 degrees, more specifically, being about −10 degrees, which is implemented by the overturning means 44 described later.

When the answer to the inquiry at step S2 is YES, i.e., when the sensed opening degree, which is sensed with the low pressure EGR opening degree sensor, is the corresponding opening degree that corresponds to the maximum opening degree of the intake air throttle valve 7, which is limited by the valve side mechanical stopper 12, the operation proceeds to step S3. At step S3, it is determined that there is no abnormality (i.e., it is normal), and the control routine is terminated.

In contrast, when the answer to the inquiry at step S2 is NO, i.e., when the sensed opening degree, which is sensed with the low pressure EGR opening degree sensor, differs from the corresponding opening degree that corresponds to the maximum opening degree of the intake air throttle valve 7, which is limited by the valve side mechanical stopper 12, the operation proceeds to step S4. At step S4, it is determined that there is the abnormality (failure) at the intake air throttle valve 7 caused by, for example, the link failure of the link device 9, and the occurrence of the abnormality is indicated by, for example, lighting a warning lamp (e.g., a malfunction indicator lamp that is abbreviated as MIL). Then, the control routine is terminated.

When the answer to the inquiry at step S1 is YES (the engine 2 being running), the operation proceeds to step S5. At step S5, it is determined whether the actual intake air flow quantity, which is sensed with the air flow meter 22 (an intake air sensor, which is placed in the intake air passage 4 and senses the intake air flow quantity), generally coincides with, i.e., generally equal to a target intake air flow quantity that corresponds to the operational state of the engine 2.

When the answer to the inquiry at step S5 is YES (i.e., the actual intake air flow quantity and the target intake air flow quantity generally coinciding with each other), the operation proceeds to step S6. At step S6, it is determined that there is no abnormality, and the control routine is terminated.

In contrast, when the answer to the inquiry at step S5 is NO (the actual intake air flow quantity not coinciding with the target intake air flow quantity), the operation proceeds to step S7. At step S7, it is determined that there is the possibility of the failure of the intake air throttle valve 7 causing the intake air throttle valve 7 being held at the position for closing the intake air passage 4. Thus, the engine 2 is controlled to a limp-back mode by, for example, limiting the engine torque. Then, the control routine is terminated.

In the above example, the intake air defect sensing program, which is executable to sense the failure of the intake air throttle valve 7 in the running state of the engine 2, is implemented as follows. That is, only the actual intake air flow quantity is sensed with the air flow meter 22. Then, it is determined whether the failure of the intake air throttle valve 7 exists in the running state of the engine 2 based on the relationship between the actual intake air flow quantity, which is sensed with the air flow meter 22, and the target intake air flow quantity, which is computed based on the operational state of the engine 2.

Alternatively, a supercharging pressure and an intake air temperature may be sensed. Then, an intake air quantity in the cylinder may be computed based on the sensed supercharging pressure and the sensed intake air temperature. Thereafter, it may be determined whether the failure of the intake air throttle valve 7 exists in the running state of the engine 2 based on a relationship between the intake air quantity in the cylinder and the actual air flow quantity, which is sensed with the air flow meter 22.

Further alternatively, an actual EGR flow quantity may be computed based on the actual intake air flow quantity, which is sensed with the air flow meter 22. Then, it may be determined whether the failure of the intake air throttle valve 7 exists in the running state of the engine 2 based on a relationship between the computed actual EGR flow quantity and the target EGR flow quantity, which corresponds to the operational state of the engine 2.

Now, advantages of the first embodiment will be described.

In the low pressure EGR apparatus 1 of the first embodiment, it is only required to drive the single electric actuator 8 to rotate the low pressure EGR regulating valve 6 and thereby to recirculate the small quantity of the EGR gas to the engine 2 with the high accuracy while the opening degree of the intake air throttle valve 7 is set to the maximum opening degree thereof. Also, by driving the single electric actuator 8 to rotate the low pressure EGR regulating valve 6, the opening degree of the low pressure EGR regulating valve 6 and the opening degree of the intake air throttle valve 7 are simultaneously adjusted to recirculate the large quantity of the EGR gas to the engine 2 through use of the low pressure EGR apparatus 1.

In the low pressure EGR apparatus 1 of the first embodiment, the failure sensing means, which is implemented in the ECU 38, is operated after the stopping of the engine 2 to execute the failure determination. When the sensed opening degree of the low pressure EGR opening degree sensor, which senses the opening degree of the low pressure EGR regulating valve 6, differs from the corresponding opening degree (the opening degree of the low pressure EGR regulating valve 6 for closing the low pressure EGR passage 5), which corresponds to the maximum opening degree of the intake air throttle valve 7 limited by the valve side mechanical stopper 12 (or the link side mechanical stopper 13), it is determined that the low pressure EGR regulating valve 6 and the intake air throttle valve 7 are abnormal due, for example, the fastening (sticking) abnormality of the link device 9.

Specifically, the presence of the failure of the intake air throttle valve 7 is sensed with the low pressure EGR opening degree sensor, which senses the opening degree of the low pressure EGR regulating valve 6. When it is determined that the failure of the intake air throttle valve 7 is present, the failure of the intake air throttle valve 7 is notified to, for example, the occupant (e.g., the driver) of the vehicle by, for example, the displaying of the abnormality.

As discussed above, in the low pressure EGR apparatus 1 of the first embodiment, the opening degree of the low pressure EGR regulating valve 6 and the opening degree of the intake air throttle valve 7 are controlled through the single electric actuator 8 and the link device 9. However, it is not required to provide the dedicated opening degree sensor to the intake air throttle valve 7, which senses the failure of the intake air throttle valve 7. Therefore, the failure of the intake air throttle valve 7 can be sensed while the cost of the low pressure EGR apparatus 1 is minimized.

Furthermore, the low pressure EGR apparatus 1 of the first embodiment has the intake air defect sensing program, which senses the presence of the failure of the intake air throttle valve 7 based on the intake air state (the shortage of the supercharge and/or the intake air flow quantity) of the intake air supplied to the engine 2 during the running state of the engine 2. Therefore, even when the intake air throttle valve 7 fails by being held at the position for closing the intake air passage 4 in the running state of the engine 2, the engine 2 can be controlled to the limp-back mode by, for example, limiting the engine torque.

The low pressure EGR regulating valve 6 of the first embodiment includes the overturning means 44 for overturning the low pressure EGR regulating valve 6 from one side of the full closed position of the valve 6 where the full open position of the valve 6 is located to the other side of the full closed position of the valve 6 opposite from the full open position of the valve 6 after passing through the full closed position to open the low pressure EGR passage 5 by the predetermined amount.

Now, the overturning means 44 will be described specifically.

The positional relationship between the cam groove 10 and the driven-side pin 43 shown in FIG. 1 is as follows. That is, the low pressure EGR regulating valve 6 is placed to have the opening degree of 0 degrees, at which the low pressure EGR regulating valve 6 completely closes the low pressure EGR passage 5 (indicated by a dot-dash line θ0 in FIG. 1). In the normal operational period, the low pressure EGR regulating valve 6 is rotated in the direction of an arrow R1 in FIG. 1, so that the opening degree of the low pressure EGR regulating valve 6 is changed from 0 degrees toward 90 degrees.

The low pressure EGR regulating valve 6 is rotatable from 0 degrees (indicated by the dot-dash line θ0 in FIG. 1) toward a minus angular range (a direction of an arrow R2 in FIG. 1) by a predetermined angle (e.g., −10 degrees). Specifically, the low pressure EGR regulating valve 6 is rotatable from the position shown in FIG. 1 until the end part of the cam groove 10 abuts, i.e., contacts the driven-side pip 43 (until the time of contacting of the link side mechanical stopper 13).

Therefore, in the deenergized state of the electric actuator 8 at the time of, for example, the engine stop, the urging force of the low pressure EGR valve return spring 61 and the overturning means 44 cause the low pressure EGR regulating valve 6 to stop at the position where the low pressure EGR passage 5 is opened by the small amount.

In this way, it is possible to avoid the malfunction, such as the unintentional fastening (sticking) of the low pressure EGR regulating valve 6 to the inner wall of the low pressure EGR passage 5.

Furthermore, at the time immediately before stopping of the engine 2 or immediately after starting of the engine 2, when the engine 2 is operated in the state where the low pressure EGR regulating valve 6 opens the low pressure EGR passage by the small amount due to the action of the overturning means 44, the EGR gas (exhaust gas) flows through the small gap between the low pressure EGR regulating valve 6 and the inner peripheral wall of the low pressure EGR passage 5 to blow a deposit held in that gap. Thereby, the reliability of the low pressure EGR regulating valve 6 can be improved.

(Second Embodiment)

Figure 7:
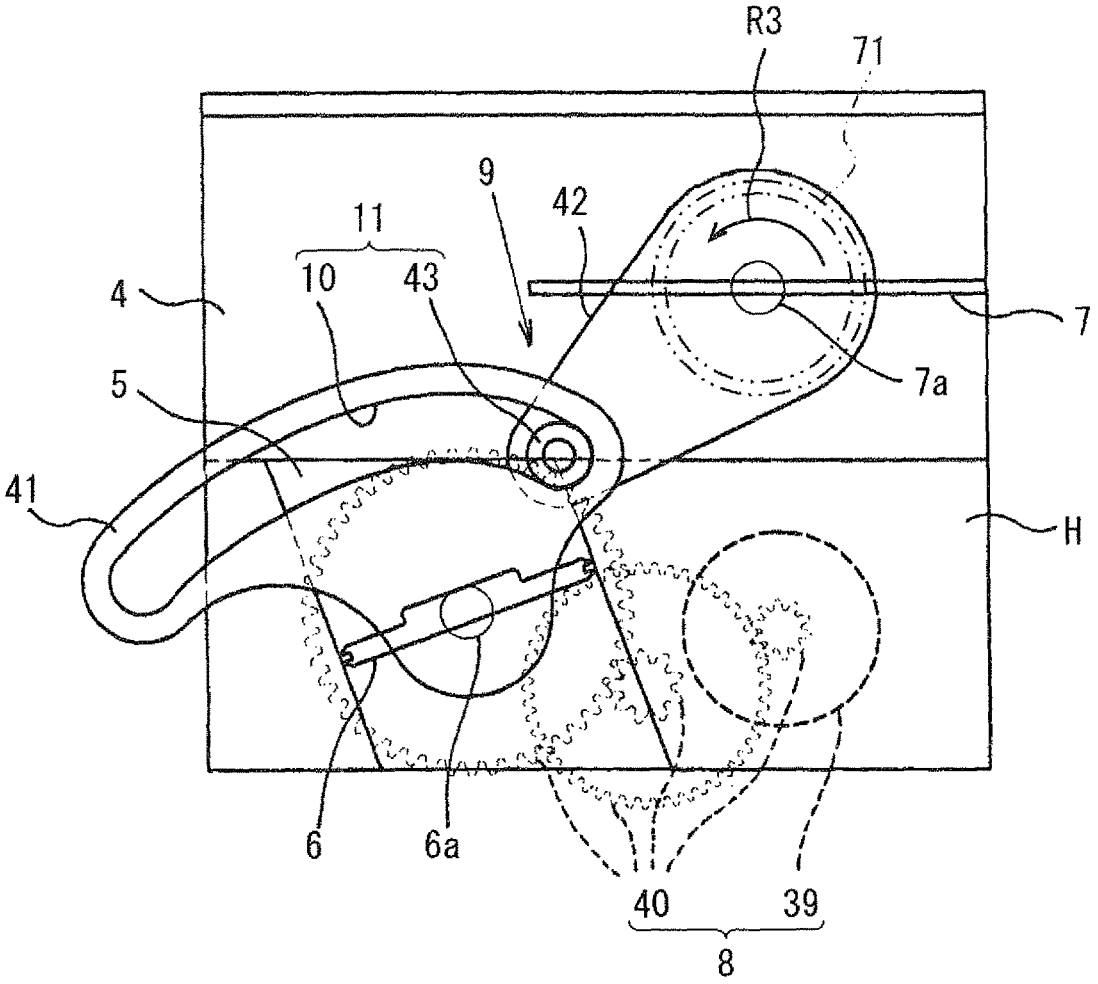
FIG. 7 is a schematic diagram showing a low pressure EGR regulating valve and an intake air throttle valve according to a second embodiment of the present invention.

A second embodiment of the present invention will be described with reference to FIG. 7. In the following description of the embodiment, components, which are similar to those of the first embodiment, will be indicated by the same reference numerals. Also, the permanent magnets 62, the magnetic sensor 81 and the low pressure EGR valve return spring 61 of the low pressure EGR apparatus 1 shown in FIG. 1 of the first embodiment are not depicted for the sake of simplicity.

The low pressure EGR apparatus 1 of the second embodiment has a throttle valve return spring 71, which applies an urging force against the intake air throttle valve 7 toward the opening direction of the intake air throttle valve 7 for opening the intake air passage 4.

Specifically, the throttle valve return spring 71 of the present embodiment is a helical torsion spring, which is placed at one end part of the throttle valve support shaft 7*a* and applies the urging force against the throttle valve support shaft 7*a* of the intake air throttle valve 7 toward the opening direction (a direction of an arrow R3 in FIG. 7) of the intake air throttle valve 7 for opening the intake air passage 4.

In this way, even when the link device 9 fails to place the intake air throttle valve 7 into the free state, the intake air throttle valve 7 can be urged toward the opening direction of the intake air throttle valve 7 thorough the action of the throttle valve return sprig 71. Thus, it is possible to limit occurrence of the intake air defect and the super charging pressure defect, which would be caused by the fastening (sticking) of the intake air throttle valve 7 at the closing position thereof for closing the intake air passage 4. That is, the throttle valve return spring 71 can achieve the fail-safe against the failure of the intake air throttle valve 7.

(Third Embodiment)

A third embodiment of the present invention will be described with reference to FIG. 8.

In the third embodiment, the intake air throttle valve 7 is formed as a butterfly valve, which regulates the opening degree of the intake air passage 4 by rotating the throttle valve support shaft (serving as a rotatable shaft) 7*a*, which is placed in and fixed to an intermediate part of a valve plate 7*p*. This butterfly valve is constructed such that a fluid contact surface area of a downstream side valve plate portion 7*b* of the valve plate 7*p*, which is placed on the downstream side of the throttle valve support shaft 7*a* in the intake air flow direction, is larger than a fluid contact surface area of an upstream side valve plate portion 7*c* of the valve plate 7*p*, which is placed on the upstream side of the throttle valve support shaft 7*a* in the intake air flow direction.

Figure 8:
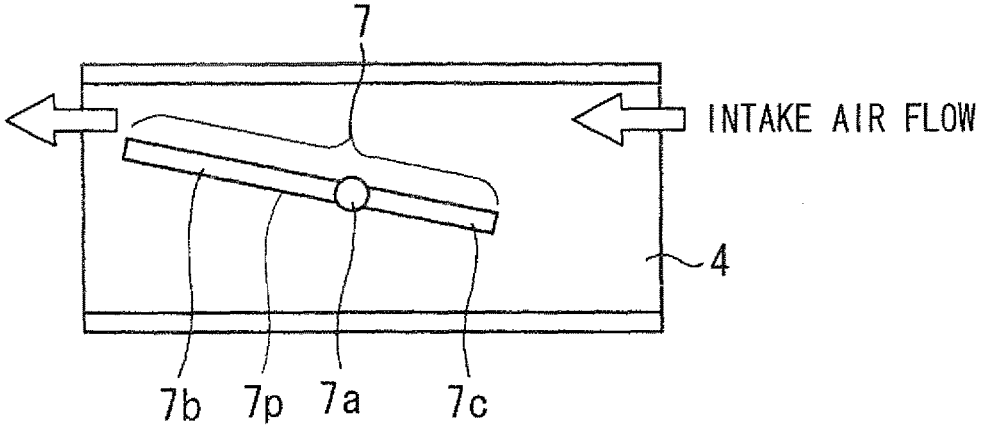
FIG. 8 is a schematic diagram showing a valve shape of an intake air throttle valve according to a third embodiment of the present invention.

Specifically, as shown in FIG. 8, a length of the downstream side valve plate portion 7*b*, which is seen from the axial direction of the throttle valve support shaft 7*a*, is longer than a length of the upstream side valve plate portion 7*c*.

Thus, even when the intake air throttle valve 7 is placed into the free state due the occurrence of the failure of the link device 9, the intake air throttle valve 7 can be driven by the intake air flow in the intake air passage 4 to rotate the intake air throttle valve 7 in the valve opening direction thereof for opening the intake air passage 4. Thus, it is possible to limit occurrence of the fastening (sticking) of the intake air throttle valve 7 at the closing position thereof for closing the intake air passage 4, so that it is possible to limit the occurrence of the intake air defect and the super charging pressure defect, which would be caused by the fastening (sticking) of the intake air throttle valve 7 at the closing position thereof for closing the intake air passage 4. Specifically, by using the butterfly valve, which has the unbalanced shape (i.e., the butterfly valve that is non-symmetrical about the rotational axis), it is possible to implement the fail-safe measure against the failure of the intake air throttle valve 7.

Figure 9:
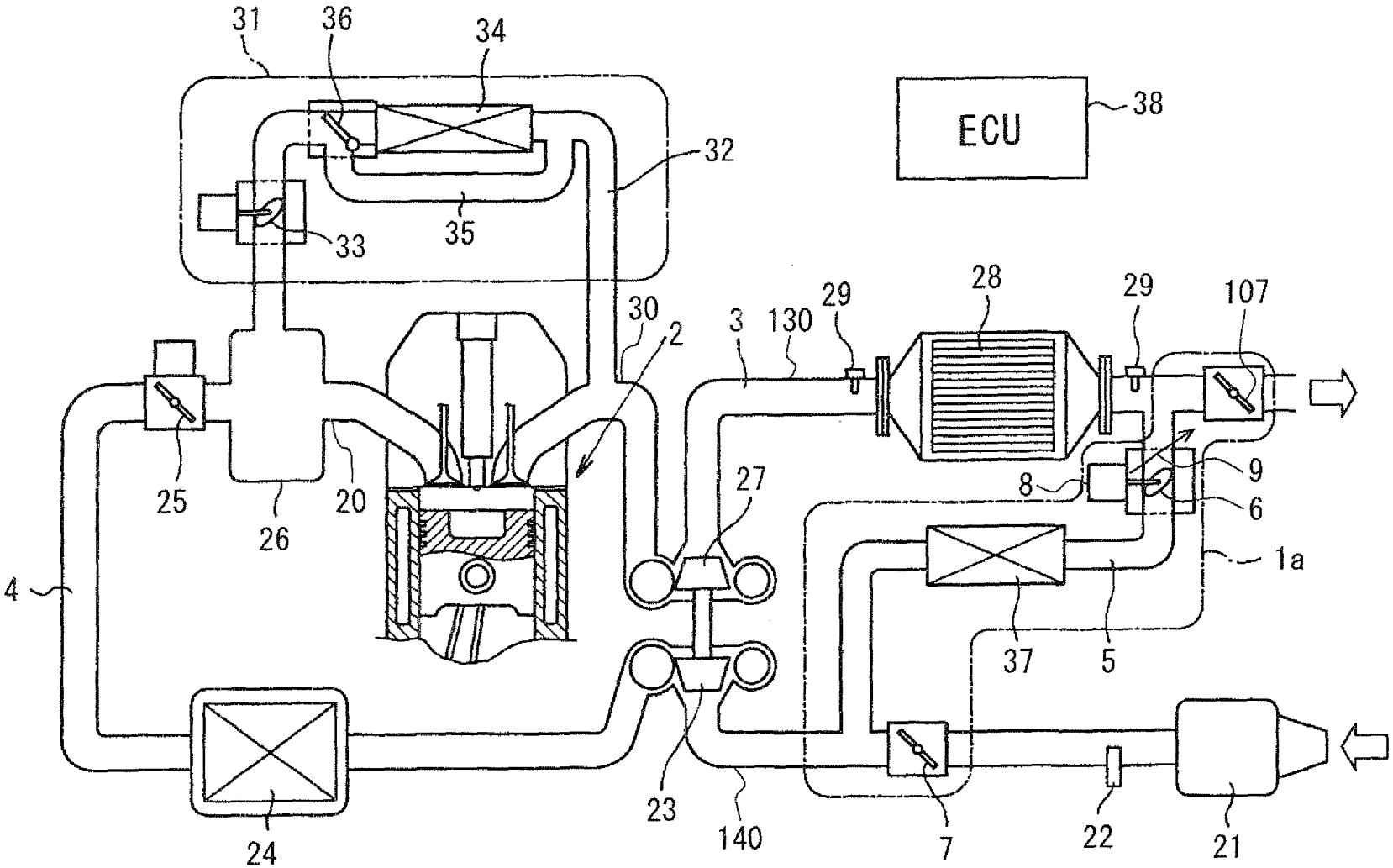
FIG. 9 is a schematic diagram showing a modification of the intake and exhaust system shown in FIG. 5.
Figure 10:
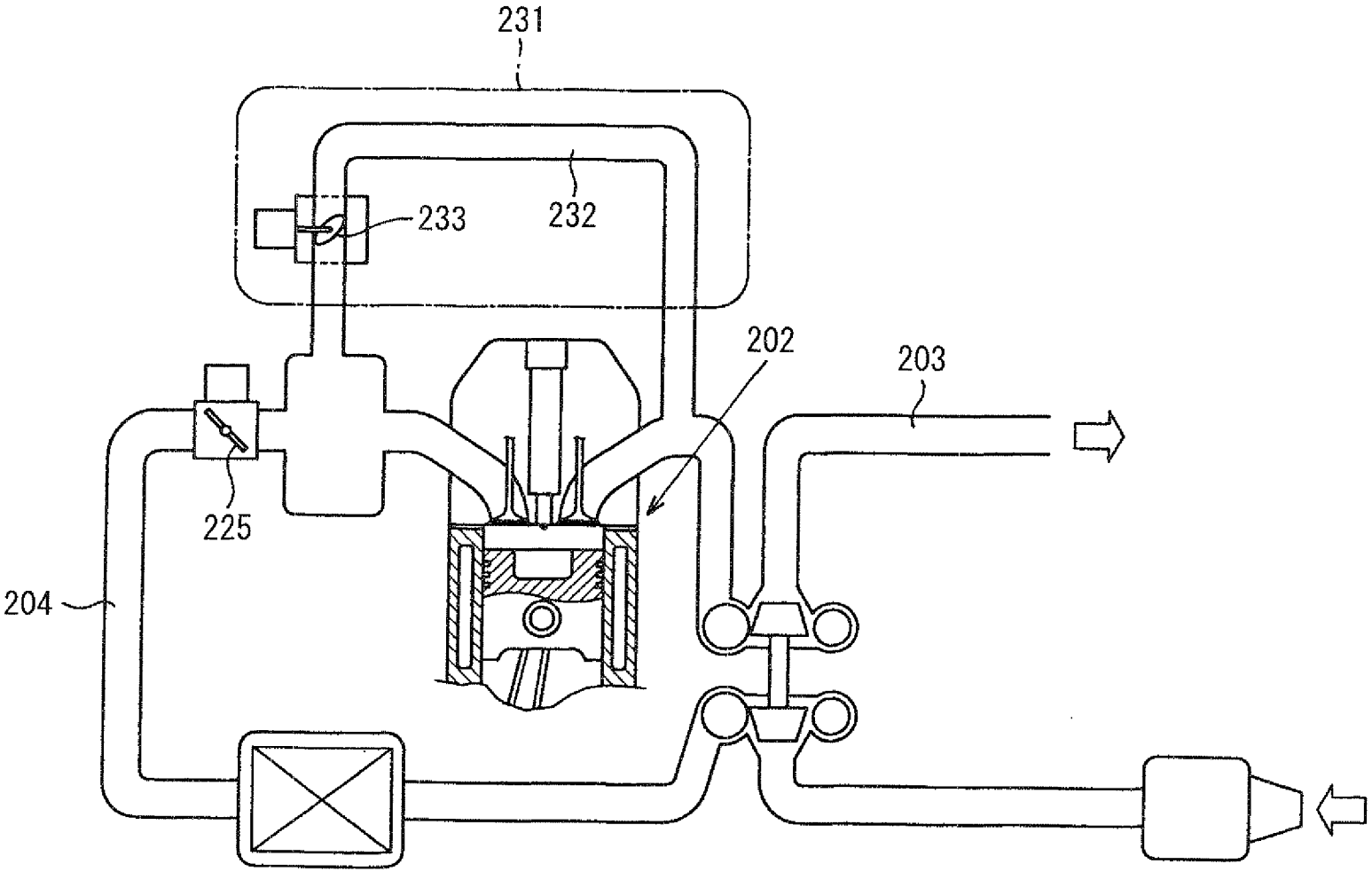
FIG. 10 RELATED ART
FIG. 10 is a schematic diagram of an intake and exhaust system of an internal combustion engine in a previously proposed technique.

In the above embodiments, the intake air throttle valve 7 is discussed as the throttle valve, which increases the EGR flow quantity in the low pressure EGR apparatus 1. Alternatively, the present invention may be implemented in a low pressure EGR apparatus 1*a* shown in FIG. 9. In the low pressure EGR apparatus 1*a*, an exhaust gas throttle valve 107 is placed in the exhaust passage 3 at a location on a downstream side of the connection between the exhaust passage 3 and the low pressure EGR passage 5 and is adapted to reduce the opening degree of the exhaust passage 3 at the time of increasing the EGR flow quantity. The low pressure EGR regulating valve 6 and the exhaust gas throttle valve 107 are linked by the link device 9 in a manner similar to that of the low pressure EGR regulating valve 6 and the intake air throttle valve 7 of the first embodiment and are driven by the drive force of the electric actuator 8 in a manner similar to that of the first embodiment. Even when the present invention is applied in the low pressure EGR apparatus 1*a*, which has the exhaust gas throttle valve 107, it is possible to execute the failure determination of the exhaust gas throttle valve 107 without using the dedicated opening degree sensor that senses the opening degree of the exhaust gas throttle valve 107 in a manner similar to one discussed in the first embodiment. Therefore, it is possible to limit the costs of the low pressure EGR apparatus 1*a*, which has the exhaust gas throttle valve 107. Here, a throttle valve return spring, which is similar to the throttle valve return spring 71, may be provided to the exhaust gas throttle valve 107 in a manner similar to one discussed in the second embodiment, if desired.

In the above embodiments, the link device 9, which can change the output (output characteristic) of the electric actuator 8 with the high degree of freedom, has the cam groove 10 and the driven-side pin 43, which are engaged with each other to transmit the drive force. However, the means, which changes the output (output characteristic) of the electric actuator 8, may be changed to any other appropriate means. For instance, the cam groove 10 may be replaced with a cam nose. Furthermore, the drive force transmitting means of the link device 9 may be changed to any other appropriate member(s), such as a gear.

In the above embodiments, the present invention is applied in the intake and exhaust system of the engine 2, which has the turbocharger. Alternatively, the present invention may be applied in an intake and exhaust system of the engine having any other type of an intake supercharger. Furthermore, the present invention may be applied in an intake and exhaust system of the engine having no intake supercharger.

In the above embodiments, the present invention is applied to the intake and exhaust system of the diesel engine. Alternatively, the present invention may be applied to an intake and exhaust system of any other type of internal combustion engine(s), such as a gasoline engine.

What is claimed is:

1. A low pressure exhaust gas recirculation apparatus for an internal combustion engine that is communicated with an intake air passage, through which intake air is supplied to the internal combustion engine, and an exhaust passage, through which exhaust gas of the internal combustion engine is released to atmosphere, the low pressure exhaust gas recirculation apparatus comprising:

a low pressure exhaust gas recirculation (EGR) passage, which is configured to recirculate the exhaust gas as EGR gas from a low exhaust gas pressure area of the exhaust passage to a low negative intake air pressure generating area of the intake air passage;

a low pressure EGR regulating valve, which regulates an opening degree of the low pressure EGR passage to regulate a flow quantity of the EGR gas through the low pressure EGR passage;

a throttle valve, which is adapted to reduce an opening degree of one of the intake air passage and the exhaust passage to increase an EGR flow quantity of the EGR gas in the low pressure EGR passage;

an electric actuator, which drives the low pressure EGR regulating valve;

a link device, which converts an output of the electric actuator to drive the throttle valve;

a low pressure EGR opening degree sensor, which senses an opening degree of the low pressure EGR regulating valve;

a low pressure EGR valve return spring, which urges the low pressure EGR regulating valve in a closing direction thereof for closing the low pressure EGR passage upon stopping of energization of the electric actuator;

a mechanical stopper, which limits a maximum opening degree of the throttle valve; and a failure sensing means for executing a failure determination to determine presence of a failure in a case where a sensed opening degree, which is sensed with the low pressure EGR opening degree sensor, is other than an opening degree that corresponds to a maximum opening degree of the throttle valve limited by the mechanical stopper, wherein the failure sensing means is activated after the energization of the electric actuator is stopped in response to stopping of the internal combustion engine.

2. The low pressure exhaust gas recirculation apparatus according to claim 1, wherein the throttle valve is an intake air throttle valve, which is adapted to change the opening degree of the intake air passage at a location on an upstream side of a connection between the intake air passage and the low pressure EGR passage in a flow direction of the intake air.

3. The low pressure exhaust gas recirculation apparatus according to claim 1, wherein the throttle valve is an exhaust throttle valve, which is adapted to change the opening degree of the exhaust passage at a location on a downstream side of a connection between the exhaust passage and the low pressure EGR passage in a flow direction of the exhaust gas.

4. The low pressure exhaust gas recirculation apparatus according to claim 2, wherein the failure sensing means senses an intake air state of the intake air supplied to the internal combustion engine during a running state of the internal combustion engine and executes the failure determination based on the sensed intake air state.

5. The low pressure exhaust gas recirculation apparatus according to claim 1, further comprising a throttle valve return spring, which applies an urging force against the throttle valve in an opening direction thereof for opening the one of the intake air passage and the exhaust passage.

6. The low pressure exhaust gas recirculation apparatus according to claim 1, wherein:

the throttle valve is a butterfly valve, which regulates the opening degree of the one of the intake air passage and the exhaust passage by rotating a rotatable shaft of the butterfly valve, which is placed in an intermediate part of a valve plate of the butterfly valve; and a fluid contact surface area of a downstream side valve plate portion of the valve plate, which is placed on a downstream side of the rotatable shaft, is larger than a fluid contact surface area of an upstream side valve plate portion of the valve plate, which is placed on an upstream side of the rotatable shaft, when the throttle valve is placed in a position, at which the opening degree of the one of the intake air passage and the exhaust passage is equal to or larger than a predetermined opening degree.

7. The low pressure exhaust gas recirculation apparatus according to claim 1, wherein:

the low pressure EGR regulating valve includes an overturning means for overturning the low pressure EGR regulating valve from a first side of a full closed position of the low pressure EGR regulating valve, the first side including a full open position of the low pressure EGR regulating valve, to a second side of the full closed position, the second side of the full closed position opposite from the first side of the full closed position, after passing through the full closed position to open the low pressure EGR passage by a predetermined amount when the low pressure EGR regulating valve is driven from the one side of the full closed position to the other side of the full closed position; and the low pressure EGR regulating valve is stopped at a position, at which the low pressure EGR passage is opened by the predetermined amount, through action of the low pressure EGR valve return spring and the overturn means upon the stopping of the internal combustion engine.

8. The low pressure exhaust gas recirculation apparatus according to claim 1, wherein:

an inlet of the low pressure EGR passage is configured to be connected to the low exhaust gas pressure area of the exhaust passage located on a downstream side of an exhaust manifold; and an outlet of the low pressure EGR passage is configured to be connected to the low negative intake air pressure generation area of the intake air passage located on an upstream side of an intake manifold.

9. The low pressure exhaust gas recirculation apparatus according claim 8, wherein the inlet of the low pressure EGR passage is configured to be connected to the low exhaust gas pressure area of the exhaust passage located on a downstream side of a particulate filter in the exhaust passage.

10. The low pressure exhaust gas recirculation apparatus according to claim 1, wherein:

an inlet of the low pressure EGR passage is configured to be connected to the low exhaust gas pressure area of the exhaust passage located on a downstream side of a high exhaust gas pressure area of the exhaust passage, at which an inlet of a high pressure EGR passage of a high pressure EGR apparatus is connected;

an outlet of the low pressure EGR passage is configured to be connected to the low negative intake air pressure generating area of the intake air passage located on an upstream side of a high negative intake air pressure generating area of the intake air passage, at which an outlet of the high pressure EGR passage is connected to recirculate the exhaust gas as EGR gas from the exhaust passage to the intake air passage;

an exhaust gas pressure in the low exhaust gas pressure area of the exhaust passage is smaller than that of the high exhaust gas pressure area of the exhaust passage when the internal combustion engine is running; and a negative intake air pressure in the low negative intake air pressure generating area of the intake air passage is smaller than that of the high negative intake air pressure generating area of the intake air passage when the internal combustion engine is running.

11. A low pressure exhaust gas recirculation apparatus for an internal combustion engine that is communicated with an intake air passage, through which intake air is supplied to the internal combustion engine, and an exhaust passage, through which exhaust gas of the internal combustion engine is released to atmosphere, the low pressure exhaust gas recirculation apparatus comprising:

a low pressure exhaust gas recirculation (EGR) passage which is configured to recirculate the exhaust gas as EGR gas from a low exhaust gas pressure area of the exhaust passage to a low negative intake air pressure generating area of the intake air passage;

a low pressure EGR regulating valve which regulates an opening degree of the low pressure EGR passage to regulate a flow quantity of the EGR gas through the low pressure EGR passage;

a throttle valve which is adapted to reduce an opening degree of one of the intake air passage and the exhaust passage to increase an EGR flow quantity of the EGR gas in the low pressure EGR passage;

an electric actuator which drives the low pressure EGR regulating valve;

a link device Which converts an output of the electric actuator to drive the throttle valve; a low pressure EGR opening degree sensor which senses an opening degree of the low pressure EGR regulating valve;

a low pressure EGR valve return spring which urges the low pressure EGR regulating valve in a closing direction thereof for closing the low pressure EGR passage upon stopping of energization of the electric actuator;

a mechanical stopper which limits a maximum opening degree of the throttle valve; and a processing system, including at least one computer processor, the processing system configured to determine, in response to a determination that the internal combustion engine has stopped, whether the low pressure EGR opening degree sensor senses an opening degree of the low pressure EGR regulating valve other than an opening degree that corresponds to the maximum opening degree of the throttle valve.

* * * * *